US007716945B2

(12) United States Patent
Weng

(10) Patent No.: US 7,716,945 B2
(45) Date of Patent: May 18, 2010

(54) PRESSURE EQUALIZATION PORT APPARATUS AND METHOD FOR A REFRIGERATION UNIT

(75) Inventor: Chuan Weng, Weaverville, NC (US)

(73) Assignee: Thermo Fisher Scientific (Asheville) LLC, Asheville, NC (US)

( * ) Notice: Subject to any disclaimer, the term of this patent is extended or adjusted under 35 U.S.C. 154(b) by 664 days.

(21) Appl. No.: 11/100,411

(22) Filed: Apr. 7, 2005

(65) Prior Publication Data

US 2006/0225455 A1 Oct. 12, 2006

(51) Int. Cl.
*F25D 11/00* (2006.01)

(52) U.S. Cl. ..... 62/440; 62/410

(58) Field of Classification Search ..... 62/60, 62/273, 275, 278, 409, 410, 440; 98/87, 98/119; 137/341, 828
See application file for complete search history.

(56) References Cited

U.S. PATENT DOCUMENTS

| | | | | | |
|---|---|---|---|---|---|
| 3,664,150 | A * | 5/1972 | Patterson | 62/234 |
| 3,813,896 | A * | 6/1974 | Lebahn | 62/409 |
| 3,952,542 | A * | 4/1976 | Berkowitz | 62/409 |
| 4,257,445 | A | 3/1981 | Cook et al. | 137/341 |
| 4,569,208 | A * | 2/1986 | Villa | 62/273 |
| 4,662,270 | A | 5/1987 | Fiddler et al. | 98/82 |
| 4,718,250 | A * | 1/1988 | Warren | 62/278 |
| 4,759,198 | A | 7/1988 | Yamada | 62/409 |
| 5,165,252 | A * | 11/1992 | Hannibalsen | 62/273 |
| 5,230,224 | A * | 7/1993 | Ricketts et al. | 62/292 |
| 5,499,514 | A | 3/1996 | Ho | 62/291 |
| 5,836,170 | A | 11/1998 | Perkins et al. | 62/409 |
| 6,176,776 | B1 | 1/2001 | Finkelstein et al. | 454/195 |
| 6,374,620 | B1 | 4/2002 | Markey | 62/89 |
| 6,397,620 | B1 * | 6/2002 | Kelly et al. | 62/275 |
| 6,432,174 | B1 * | 8/2002 | Heung | 95/289 |
| 6,598,517 | B1 * | 7/2003 | McCausland | 99/472 |
| 6,672,094 | B1 * | 1/2004 | Carden et al. | 62/273 |
| 6,672,096 | B2 * | 1/2004 | Lopes | 62/331 |
| 6,718,776 | B2 * | 4/2004 | Wessling et al. | 62/60 |
| 6,843,065 | B2 * | 1/2005 | Flynn | 62/156 |
| 7,201,003 | B2 * | 4/2007 | Clarke | 62/51.1 |
| 2001/0047826 | A1 * | 12/2001 | Ishigaki | 137/341 |
| 2005/0236055 | A1 * | 10/2005 | Crocker et al. | 137/828 |
| 2007/0262180 | A1 * | 11/2007 | Adams | 239/738 |

* cited by examiner

*Primary Examiner*—Marc E Norman
(74) *Attorney, Agent, or Firm*—Wood, Herron & Evans, LLP

(57) ABSTRACT

A pressure equalization port for a refrigeration unit is provided. The port includes a conduit having a thermally conductive body. The conduit includes a first opening exposed to a refrigeration chamber enclosed within the refrigeration unit, and a second opening exposed to a space external to the refrigeration chamber. At least one heat-dissipating refrigerant flow coil surrounds a portion of the thermally conductive body to heat said body.

18 Claims, 3 Drawing Sheets

PRESSURE EQUALIZATION PORT APPARATUS AND METHOD FOR A REFRIGERATION UNIT

FIELD OF THE INVENTION

The present invention relates generally to refrigeration systems. More particularly, the present invention relates to pressure equalization devices for use with low-temperature refrigerator units.

BACKGROUND OF THE INVENTION

In refrigeration systems, a typical refrigeration unit includes at least one chamber which is cooled to low temperature. The chamber is accessed by a door which, when closed, creates a seal to preserve the low temperature in the chamber. However, because of this seal, the chamber may periodically trap high temperature and high moisture-level air when the door is open and closed. Once trapped inside the sealed chamber, this warm wet air is rapidly cooled and contracts to create a low pressure in the chamber space. The resulting pressure differential between the inside and outside of the refrigeration unit chamber can present undesirable structural stresses on the unit and prevent ready re-opening of the chamber door. This pressure differential can be markedly higher in various ultra low temperature storage chambers created by industrial strength refrigeration units, such as those using cascading coil arrangements. The extreme pressure differentials created in such ultra low temperature chambers can affect the structural integrity of the device and severely reduce the practical use of the refrigeration unit.

A number of devices to equalize this pressure differential have been developed, many of which are called "pressure equalization ports", or, alternatively, pressure relief ports, vents, or ventilators. All of the devices provide for a flow lumen or passage to be disposed between the sealed chamber and the outside of the refrigeration unit, so as to allow the flow of air therebetween. This flow allows high pressure air outside the unit to flow into the chamber when a low pressure develops, thereby equalizing pressure between the inside and outside of the unit. Pressure equalization ports and other pressure equalization devices serve the purpose of reducing the time required to open a pressurized door and access a refrigeration chamber. This time differential can be over 5 minutes, depending on pressure and port size.

With regard to port size, the flow passage cannot be so large as to allow significant heat losses, thereby negating the refrigeration achieved by the unit. The ports are therefore generally small in relation to the size of the refrigeration chamber and refrigeration unit. One drawback of existing ports is that the cooling of warm moist air in the refrigeration chamber tends to create condensation and ice crystals within the chamber. The relatively small size of flow passages and openings in existing pressure equalization ports tend to allow for the formation of ice crystals around the port as warm moist air flows through them. These ice crystals can accumulate to such a degree as to block the flow through the port. A need exists therefore, for a port that efficiently allows for equalization of pressure by providing effective flow pathways.

To improve operation, pressure equalization ports may include devices or features that heat the device and the flow through the device. Not only does this prevent the formation of condensation, but it also creates more of a pressure gradient, and therefore higher flow rates, through the port. Yet, adding such heating devices can complicate the structure of the refrigeration unit and create added costs in manufacturing and supplying the device with energy. The prior art devices supply heat energy through electric power sources, which can be inefficient in delivering thermal energy to the port, expensive in terms of energy used, and dangerous to operate and maintain. The efficiency of any heating device is also important in that adding any device generating heat near a refrigeration chamber can naturally reduce the effectiveness of the chamber. Therefore the heating apparatus and method should more effectively supply heat to the pressure equalization port without negatively affecting the overall performance of the refrigeration unit.

Accordingly, it is desirable to provide a method and apparatus for equalization of pressure differentials in refrigeration units which provides for effective flow pathways into a refrigeration chamber and efficiently prevents such flow pathways from obstruction while equalizing pressure in the chamber.

SUMMARY OF THE INVENTION

The foregoing needs are met, to a great extent, by the present invention, wherein in one aspect an apparatus is provided that in some embodiments provides for effective flow pathways into a refrigeration chamber and efficiently prevents such flow pathways from obstruction while equalizing pressure in the chamber.

In accordance with one embodiment of the present invention, a pressure equalization port for a refrigeration unit is provided. The port includes a conduit having a thermally conductive body. The conduit includes a first opening exposed to a refrigeration chamber enclosed within the refrigeration unit, and a second opening exposed to a space external to the refrigeration chamber. At least one heat-dissipating refrigerant flow coil surrounds a portion of the thermally conductive body to heat said body.

In accordance with another embodiment of the present invention, a method of equalizing a pressure differential between a refrigeration chamber enclosed within a refrigeration unit and a space external to the refrigeration chamber is provided. A conduit is mounted in the refrigeration unit. The conduit includes a thermally conductive body and first and second openings. The first opening is exposed to the refrigeration chamber. The second opening is exposed to the space external to the refrigeration chamber to allow a gas flow through the thermally conductive body. And a portion of at least one heat-dissipating refrigerant flow coil is disposed to surround a portion the thermally conductive body to heat said body.

In accordance with yet another aspect of the present invention, a pressure equalization port in a refrigeration unit is provided. The port includes a conduit means for absorbing thermal energy and allowing fluid flow between a refrigeration chamber enclosed within the refrigeration unit and a space external to the refrigeration chamber. The port also includes a means for transferring thermal energy to said conduit means from at least one heat-dissipating refrigerant flow coil disposed in the refrigeration unit.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
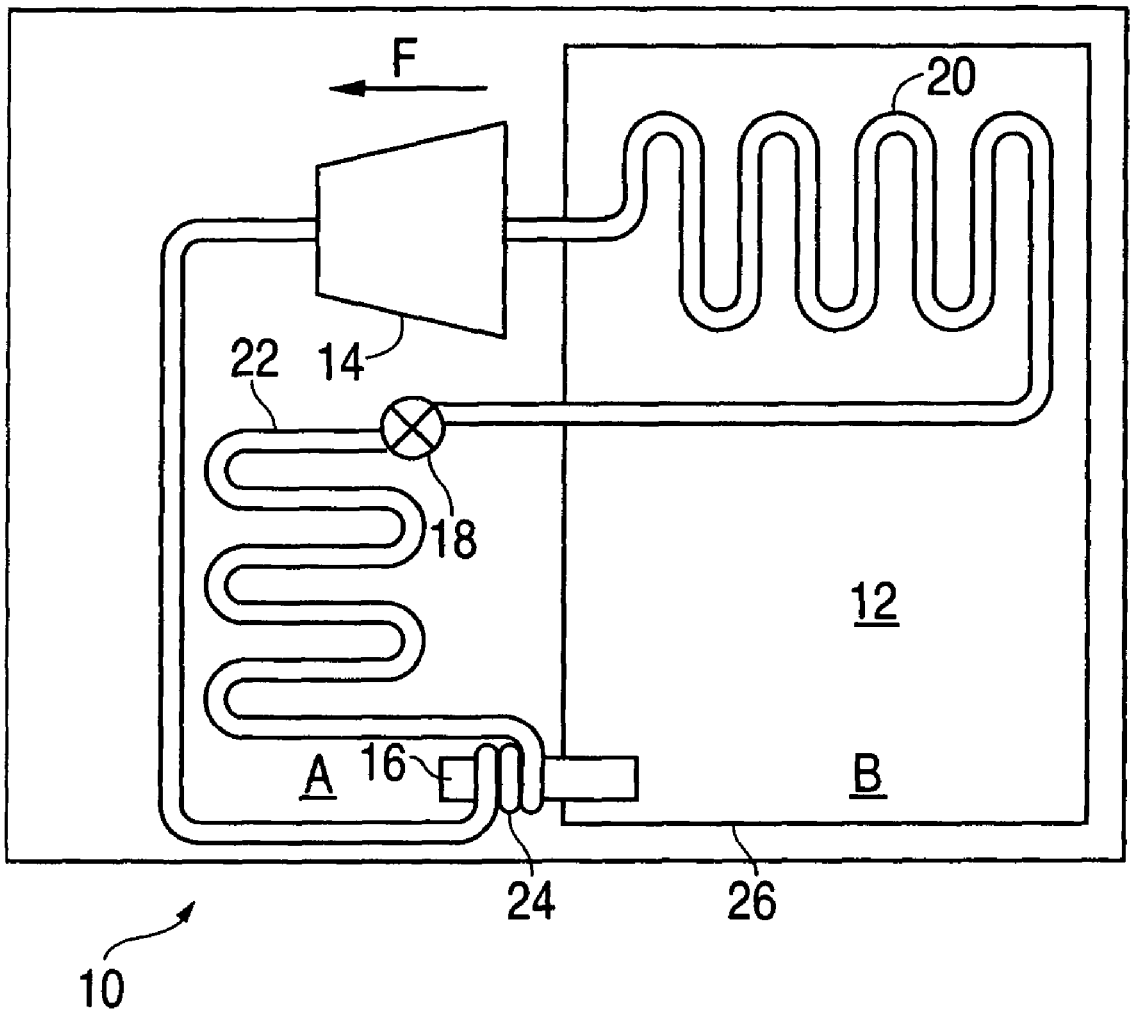
FIG. 1 is a schematic diagram illustrating a refrigeration unit having a pressure equalization port according to an embodiment of the invention.

The invention will now be described with reference to the drawing figures, in which like reference numerals refer to like parts throughout. An embodiment in accordance with the present invention provides a pressure equalization port in a refrigeration unit, having a conduit with a thermally conductive body. The conduit has openings into a refrigeration chamber enclosed within the refrigeration unit, and at least one space external to the refrigeration chamber. The refrigeration unit also includes at least one heat-dissipating refrigerant flow coil, which surrounds a portion of the thermally conductive body to heat said body. The present invention therefore provides for effective flow pathways into a refrigeration chamber from outside of the refrigeration unit, so as to effectively equalize any pressure differential that may form. The disposition of a portion of the heat-dissipating flow coil efficiently prevents such flow pathways from obstruction while also aiding in equalizing pressure in the chamber.

In refrigeration systems, a typical refrigeration unit includes a compressor for compressing a working fluid or refrigerant. The compressed refrigerant, being at relatively high pressure and temperature, initially flows from the compressor through a first heat-dissipating flow tube, whereby the refrigerant condenses from vapor to liquid. An expansion valve or orifice is thereafter used to expand the condensed refrigerant to low pressure and temperature and back to a gaseous phase. The resulting low temperature refrigerant then evaporates and flows through a heat-absorbing flow tube placed within the chamber to be refrigerated, thereby cooling its surroundings.

The heat absorbing and heat dissipating flow tubes are generally serpentine in shape so as to maximize the surface area available for conductive and convective heat transfer. As such, a heat-dissipating tube is commonly referred as a condenser coil, or "hot coil." The heat-absorbing tube is commonly referred to as an evaporator coil, or "cold coil." Yet it will be noted that a refrigeration system may include two or more coils arranged in a "cascading" system, where heat is transferred from one "hot" coil to a relative cooler refrigerant flow coil.

As used herein, all references to a "heat-dissipating refrigerant flow coil" shall mean a tube or conduit, arranged in any shape or configuration, which is fluidly coupled downstream to one or more compressors in a refrigerant unit, such that refrigerant flowing through such a heat-dissipating coil is at the higher temperature, higher pressure and higher density conditions for the working fluid in the refrigeration cycle.

Additionally, as used herein, a "condenser coil" shall also refer to any tube or conduit, arranged in any shape or configuration, which is fluidly coupled downstream to one or more compressors in a refrigerant unit, except that a "condenser coil" shall mean a coil whose primary function is to reduce the temperature of refrigerant, to cause the refrigerant to change phase from vapor to liquid, and to exothermically transfer heat from the refrigeration unit as the refrigerant flows throughout the refrigeration cycle. The condenser coil may therefore be referred to as the main or primary hot coil. This is to be distinguished from a heat-absorbing refrigerant coil disposed elsewhere along the refrigeration cycle, also referred to herein as an evaporator coil or "cold coil," whose main function is to endothermically transfer heat from its surroundings into the refrigerant flowing through said cold coil.

An embodiment of the present inventive apparatus and method is illustrated in schematic form in FIG. 1, which shows a refrigeration unit 10 having an inner refrigeration chamber 12, at least one compressor 14, a pressure equalization port 16, an expansion valve 18, at least one evaporator coil 20, and at least one condenser coil 22, a portion of which includes a heat-dissipating refrigerant flow coil 24 disposed around a portion of port 16.

All refrigeration units such as unit 10 have some form of a refrigeration chamber 12, which is a space that is chilled to low temperatures and can be accessed by opening and closing a portal or door of some kind. Once closed, to maintain a desired temperature, the chamber 12 must generally be sealed to the outside environment. Refrigerant flows along direction "F" as shown through a closed loop system defined by elements 14, 18, 20, 22, and 24 to cool the interior of chamber 12. Compressor 14 compresses refrigerant entering it to high temperature and pressure. Refrigerant then flows through condenser coil 22 where heat is transferred away from refrigeration unit 10 through conductive, convective and radiation heat transfer processes, thereby lowering the temperature of the refrigerant and causing said refrigerant to change from gas to liquid.

The condenser coil 22 may be of any shape or configuration and is generally positioned outside of the chamber 12 or outside of the structural walls of the unit 10, so that the waste heat generated by coil 22 is not transferred into the unit 10. A portion 24 of the hot coil 22, hereinafter referred to as a "PEP coil" is disposed to be wrapped around port 16 in such a way as to effectively transfer heat from the refrigerant flow into and around port 16. It is understood that coil 22 may be arranged or shaped in any number of ways and may be disposed in various configurations in or around unit 10. In accordance with the principles of the present invention, coil 22 may have a portion that is disposed around the opening of a door to the chamber 22, similar to a "HALO" coil. It is further understood that the heat-dissipating PEP coil 24 can be arranged in a number of ways around the port, and that coil 24 can form any part of the overall condenser coil 22. PEP coil 24 may, for example, be disposed upstream of the main bulk of coil 22, downstream of the main bulk of coil 22, or at some intermediate point. It is also understood that the condenser coil 22 and PEP coil 24 may be arranged in two or more separate flow lumens that branch off the output of compressor 14.

The refrigeration unit also includes an expansion valve 18 positioned downstream of the hot coil 22. Valve 18 is an orifice or other device for expanding the refrigerant flow from high pressure and density to low pressure and density, where at least a fraction of the refrigerant changes phase from liquid to vapor. After flowing past the expansion valve 18, low pressure and temperature refrigerant flows through a heat-absorbing evaporator coil 20 disposed inside of chamber 20, thereby cooling the chamber 20.

The periodic opening and sealing of chamber 12 can cause a pressure differential to develop between any exterior space "A" outside of chamber 12, and the space "B" inside the chamber 12. Oftentimes, space B is at a lower pressure than space A. This generally happens when warm moist air is trapped in space B and cools and contracts to create lower pressure inside of a constant volume in the chamber 12. However, space B can also be at a higher pressure than space A. This can occur if excess gas or fluid is trapped in chamber 12 when chamber 12 is sealed. In either case, a pressure differential can develop between spaces A and B which can put undesirable stresses and strains on the structure of refrigeration unit 10, and prevent the ready opening of a chamber door disposed between spaces A and B.

To alleviate this pressure differential, a pressure equalization port 16 is disposed in the unit 10. The port 16 is mounted anywhere in the unit 10 and spans any wall or boundary 26 of chamber 12, such as a door, a door seal, a roof, or a floor. The port 16 includes at least one conduit defining one or more flow lumens between spaces A and B. If any pressure differential develops between spaces A and B, the resulting pressure gradient through the port 16 causes flow between spaces A and B and equalizes the pressure differential.

Because a portion 24 of condenser coil 22 is closely wrapped around port 16, the heat generated by heat-dissipating coil 24 is applied to warm the port 16. This can prevent condensation and ice from accumulating in and around the flow lumens defined by port 16, leaving it unobstructed and capable of equalizing pressure. By using the waste heat generated by the coil 22, no secondary power or energy source, such as an electrical source, is needed to supply the thermal energy to port 16, thereby resulting in a more efficient and effective pressure equalization system for refrigeration unit 10.

Figure 2:
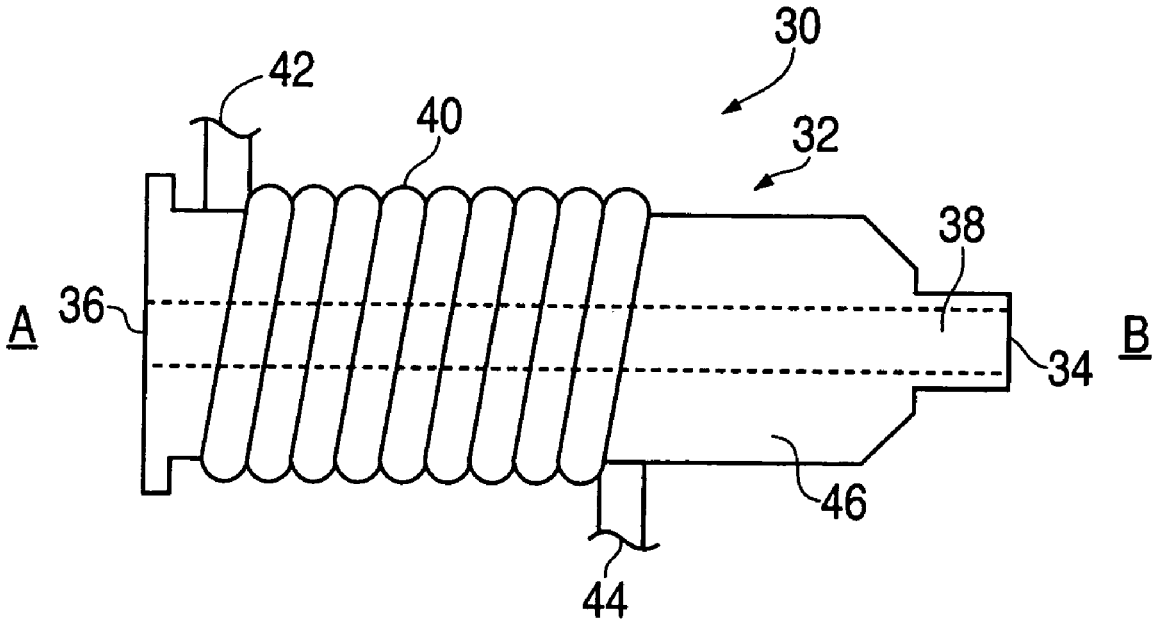
FIG. 2 is a side view showing a schematic conceptual arrangement of a pressure equalization port apparatus in accordance with one embodiment of the present invention.

FIG. 2 is a side view of a schematic conceptual arrangement for the pressure equalization port apparatus 16 shown in FIG. 1. FIG. 2 shows a pressure equalization port assembly 30 having a conduit 32 with a first opening 34 and a second opening 36. At least one flow lumen 38 is defined by the conduit 32 between the two openings 34 and 36. A heat-dissipating refrigerant flow coil 40 is arranged to surround a portion of conduit 32 and has a first end 42 and second end 44, the coil 40 being further coupled to the condenser coil 22 shown in FIG. 1.

Conduit 32 includes a thermally conductive body portion 46, which envelops the lumen 38. Conduit 32 may define any number of flow lumens and may include any number of independent and discrete passageways, and is not limited to a single unitary lumen 38 as depicted in FIG. 2. Furthermore, conduit 32 may include any other valves, vents, or other flow control devices to condition or control the flow of fluid through the lumens defined therein. In one embodiment, the conduit includes a metallic sleeve disposed around the thermally conductive body portion 46. In all cases however, conduit 32 provides for some passage of gas or fluid between space A, which is outside of the refrigeration chamber in the refrigeration unit, and space B, which is inside the refrigeration chamber.

Conduit 32 includes a thermally conductive body 46 which surrounds lumen 38. Body 46 has a relatively high thermal conductivity in order to absorb and transfer heat from coil 40 to any flow through lumen 38. Body 46 can be made of any number of materials having a high thermal conductivity, such as copper, aluminum, steel or any mixture thereof. The thermal conductivity of body 46 at room temperature is preferably at least 200 W/m·K. In addition to high thermal conductivity, body 46 has a relatively high thermal capacitance or heat capacity, such that when thermal energy is transferred to body 46, it can retain a greater quantity of heat when no energy is transferred from coil 40 as the refrigeration unit and compressor is cycled. This allows for more steady heating of lumen 38 and more efficient and effective flow through lumen 38 to equalize any pressure differential between spaces A and B. In one embodiment, body 46 has a specific heat capacity at room temperature of at least 0.300 KJ/kg·K.

Furthermore, the relative size and mass of body 46 is important to maintaining the proper heating and temperature profile through conduit 32. A higher mass naturally has the capacity to retain more heat. In one embodiment of the present invention, the mass of body 46 is at least 0.3 kg. A thermally conductive mastic may also be added to the body 46 near the openings of conduit 38 to enhance the overall capability of the apparatus to retain heat.

However, given a fixed size of the port 32, which is often dictated by the physical dimensions of the refrigeration unit, one measure of the efficiency in which the pressure equalization port 30 operates to maintain a positive temperature profile is the density of the body 46 multiplied by its specific heat capacity. This metric is hereinafter called the "critical property ratio" or "CPR," being a ratio of energy per volume and degree of temperature. Since heat transfer through the port 30 depends largely on natural convection, the heat loss from the body 46 is a strong function of the temperature differential between the body 46 and the flow in conduit 38. As heat is dissipated from body 46, a drop in the temperature differential will lower the heat transfer from the port to the flow. A body 46 which has a higher density will have a greater capacity to store thermal energy and maintain its temperature while cooling due to its greater mass per volume. Therefore the CPR is proportional to density. And a body 46 which has a higher specific heat capacity will store more thermal energy per unit of mass. Therefore the CPR is proportional to specific heat.

By multiplying the density and specific heat of the port body 46, the resulting CPR gives a measure of the amount of thermal energy dissipated from port 30 for a unit degree of decrease in temperature of body 46, normalized by the volume of the thermally conductive body 46, since that is where the thermal energy is stored between refrigeration heating and cooling cycles. The CPR is calculated below in Table 1, for three materials which can be used in the port body 46 of the present invention.

TABLE 1

| Material | Density ($kg/m^3$) | Specific Heat (KJ/kg · K) | CPR ($KJ/m^3 \cdot K$) |
|---|---|---|---|
| Aluminum | 2707 | 0.899 | 2433 |
| Copper | 8934 | 0.385 | 3439 |
| Carbon (1.5) Steel | 7837 | 0.486 | 3808 |

As can be seen from Table 1, plain carbon steel would appear to give a better performance than aluminum or copper, due to its higher CPR. It must be noted that all of the properties in Table 1 were calculated at room temperature. It is understood that deviations from room temperature would give slightly differing results. It is also understood that the CPR is only a rough measure of the performance of the pressure equalization port of the present invention. The particular configuration of the lumen or lumens in body 46 could affect the rate of heat transfer from the body 46 to the flow between regions A and B, since natural convection is also a strong function of surface area.

In one embodiment of the present invention, the CPR may be as low as 2000 $KJ/m^3 \cdot K$, although it is readily understood that this parameter could be much lower. For the various thermal loads necessary to maintain proper functionality to a pressure equalization port in a refrigeration unit having a chamber temperature of −86 degrees C., it has been empirically observed that a CPR of 2000 $KJ/m^3 \cdot K$ is sufficient. However for refrigeration units which operate at temperatures higher than −86 degrees C., a CPR of 1000 $KJ/m^3 \cdot K$ or lower may be sufficient.

Figure 3:
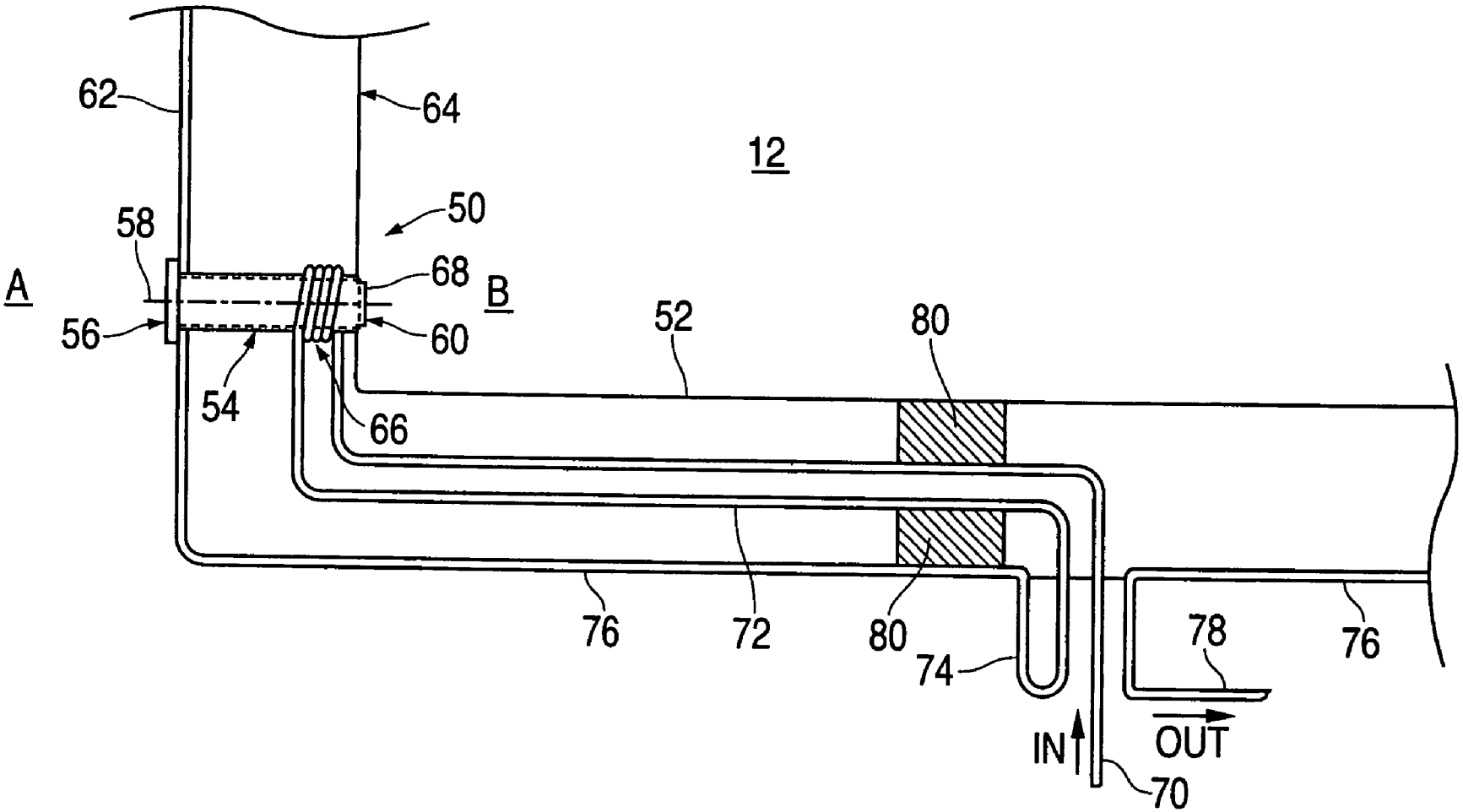
FIG. 3 is a side view of a pressure equalization port apparatus, in a portion of a refrigeration unit assembly, in accordance with another embodiment of the present invention.

An alternative embodiment of the present invention is illustrated in FIG. 3, which shows a side view of a pressure equalization port apparatus 50, in a portion of a refrigeration unit assembly 52. Port 50 includes a thermally conductive body 54 having an exterior lip portion 56 and a centerline 58. Once again the port 50 connects the space "A" exterior to refrigeration chamber 12 with space "B" inside of the chamber. A spacer 60 is included, which can be made of Teflon, for fitting the port between the walls 62 and 64 of the wrapper around chamber 12. A coil 66 is disposed around a portion of the body 54 proximal to the inner wall 64, near the opening 68 to chamber 12.

Refrigerant flowing from a compressor in the unit enters through conduit 70 and flows along arrow labeled "In" in FIG. 3 through to the coil 66 around body 54. It thereafter flows away from the coil and port 50 through conduit 72 and through a unshaped section 74 and returns to flow in a HALO coil 76 wrapped around the refrigeration unit chamber proximate the outer wall 62. After flowing all the way around HALO coil 76, the refrigeration flows past conduit 78 along the arrow labeled "Out" and is coupled to a condenser coil. Two spacer blocks 80 may be placed between the walls 62 and 64 as shown to support, brace and position the conduits connecting the coil 66.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A pressure equalization port for a refrigeration unit having a refrigeration chamber and a closed loop refrigerant flow path configured to cool an interior of the refrigeration chamber, comprising:

a conduit to equalize the air pressure between the refrigeration chamber and a space external to the refrigeration chamber, comprising:

a thermally conductive body having a lumen passing therethrough, a first opening exposed to the refrigeration chamber, and a second opening exposed to the external space; and a refrigerant flow coil, forming a portion of the closed loop refrigerant flow path and having an inlet side fluidly coupled to a compressor and an outlet side fluidly coupled to a condenser coil, surrounding at least a portion of the thermally conductive body to transfer heat thereto.

2. The pressure equalization port of claim 1, wherein said thermally conductive body has a thermal conductivity at room temperature of at least 200 W/m·K.

3. The pressure equalization port of claim 1, wherein said thermally conductive body has a thermal capacitance at room temperature of at least 0.300 KJ/kg·K.

4. The pressure equalization port of claim 1, wherein said thermally conductive body has a mass of at least 0.300 kg.

5. The pressure equalization port of claim 1, wherein said thermally conductive body has a critical property ratio of at least 2000 $KJ/m^3 \cdot K$.

6. The pressure equalization port of claim 1, wherein said thermally conductive body is in part comprised of a material selected from the group consisting of aluminum, copper, and steel.

7. A method of equalizing an air pressure differential between a refrigeration chamber enclosed within a refrigeration unit and a space external to the refrigeration chamber, the refrigeration unit having a refrigeration chamber and a closed loop refrigerant flow path configured to cool an interior of the refrigeration chamber, comprising:

mounting a conduit in the refrigeration unit, the conduit having a thermally conductive body and first and second openings joined by a lumen passing therethrough;

exposing the first opening to the refrigeration chamber;

exposing the second opening to the space external to the refrigeration chamber to equalize the air pressure between the refrigeration chamber and the external space; and disposing a refrigerant flow coil, forming a portion of the closed loop refrigerant flow path and having an inlet side fluidly coupled to a compressor and an outlet side fluidly coupled to a condenser coil, to surround at least a portion of the thermally conductive body to transfer heat thereto.

8. The method of claim 7, wherein said thermally conductive body has a thermal conductivity at room temperature of at least 200 W/m·K.

9. The method of claim 7, wherein said thermally conductive body has a thermal capacitance at room temperature of at least 300 J/kg·K.

10. The method of claim 7, wherein said thermally conductive body has a mass of at least 0.300 kg.

11. The method of claim 7, wherein said thermally conductive body has a critical property ratio of at least 2000 $KJ/m^3 \cdot K$.

12. The method of claim 7, wherein said thermally conductive body is in part comprised of a material selected from the group consisting of aluminum, copper, and steel.

13. A pressure equalization port in a refrigeration unit having a refrigeration chamber and a closed loop refrigerant flow path configured to cool an interior of the refrigeration chamber, comprising:

means for equalizing the air pressure between the refrigeration chamber enclosed within the refrigeration unit and a space external to the refrigeration chamber; and a refrigerant flow coil, forming a portion of the closed loop refrigerant flow path and having an inlet side fluidly coupled to a compressor and an outlet side coupled to a condenser coil and surrounding at least a portion of the means for equalizing the air pressure, for transferring thermal energy thereto.

14. The pressure equalization port of claim 13, wherein said means for equalizing the air pressure has a thermal conductivity at room temperature of at least 200 W/m·K.

15. The pressure equalization port of claim 13, wherein said means for equalizing the air pressure has a thermal capacitance at room temperature of at least 300 J/kg·K.

16. The pressure equalization port of claim 13, wherein said means for equalizing the air pressure has a mass of at least 0.300 kg.

17. The pressure equalization port of claim 13, wherein said means for equalizing the air pressure has a critical property ratio of at least 2000 $KJ/m^3 \cdot K$.

18. The pressure equalization port of claim 13, wherein said means for equalizing the air pressure is in part comprised of a material selected from the group consisting of aluminum, copper, and steel.

* * * * *